US005465540A

United States Patent [19]

Biernazki

[11] Patent Number: 5,465,540

[45] Date of Patent: Nov. 14, 1995

[54] FACADE STRUCTURE FOR WINDOWS

[75] Inventor: Christian P. Biernazki, White Hall, Md.

[73] Assignee: Fypon Inc., Stewartstown, Pa.

[21] Appl. No.: 174,521

[22] Filed: Dec. 28, 1993

[51] Int. Cl.[6] ..... E06B 1/04

[52] U.S. Cl. ..... 52/211; 52/210; 52/717.01; 52/656.4; 52/309.8

[58] Field of Search ..... 52/210, 211 OR, 52/717.01, 656.2, 656.3, 656.4, 656.5, 656.6, 656.7, 204.1, 309.8

[56] References Cited

U.S. PATENT DOCUMENTS

| | | | |
|---|---|---|---|
| 346,187 | 7/1886 | Boda | 52/211 |
| 2,581,750 | 1/1952 | Bursik | 52/656.2 X |
| 3,436,886 | 4/1969 | Nowak et al. | 52/211 |
| 3,676,966 | 7/1972 | Ragland | 52/211 |
| 3,769,773 | 11/1973 | Mochizuki | 52/656.4 |
| 3,812,621 | 5/1974 | Ragland | 52/210 X |
| 4,228,630 | 10/1980 | Englert et al. | 52/211 X |
| 4,341,831 | 7/1982 | Kleiss | 52/656.6 X |
| 4,920,718 | 5/1990 | Artwick et al. | 52/656.4 X |
| 5,018,325 | 5/1991 | Geen et al. | 52/211 |
| 5,119,603 | 6/1992 | Jones | 52/211 X |

*Primary Examiner*—Wynn E. Wood

*Attorney, Agent, or Firm*—Oblon, Spivak, McClelland, Maier & Neustadt

[57] ABSTRACT

A facade for a dormer window having side trim members and a pediment of molded plastic duplicating the appearance and texture of expensive wood millwork. The plastic is molded around boards having exposed rear faces. The boards give the structural strength of wood millwork to the trim and pediments and provide means for securely fixing by fasteners, such as screws the molded plastic members to a metallic skeleton frame defining an opening for pre-existing window frames.

4 Claims, 7 Drawing Sheets

FACADE STRUCTURE FOR WINDOWS

FIELD OF THE INVENTION

This invention relates to static structures and more particularly to a facade structure for dormer windows.

BACKGROUND OF THE INVENTION

Dormer windows extend out from the roof of a structure, often a residential structure, and usually have a gabled roof and a vertical window frame at its outer end which extends from the main roof to the gable. Though the facade of a dormer window may be a substantial duplicate of other windows of a building, when dormer windows are decorated with side or trim panels and gabled pediments of wood millwork, they add measurably to the overall appearance and value of a home. However, such millwork is exorbitantly expensive and thus seldom appears in modern day home construction.

The object of the present invention is to provide a knockdown assembly of components for a window facade, particularly for a dormer window, including parts identical in appearance to expensive millwork but which are, in fact, of relatively inexpensive molded foam plastic material.

Because the molded plastic material, comprising primarily side trim pieces for a window frame and a pediment for a dormer window, are structurally weak, another object of the invention is to provide means whereby the molded components may be erected in place yet be as structurally strong as they would otherwise be if they were composed solely of wood millwork.

Other objects and their attendant advantages will become apparent as the following detailed description is read in conjunction with the accompanying drawings.

DESCRIPTION OF THE PREFERRED EMBODIMENTS

Figure 1:
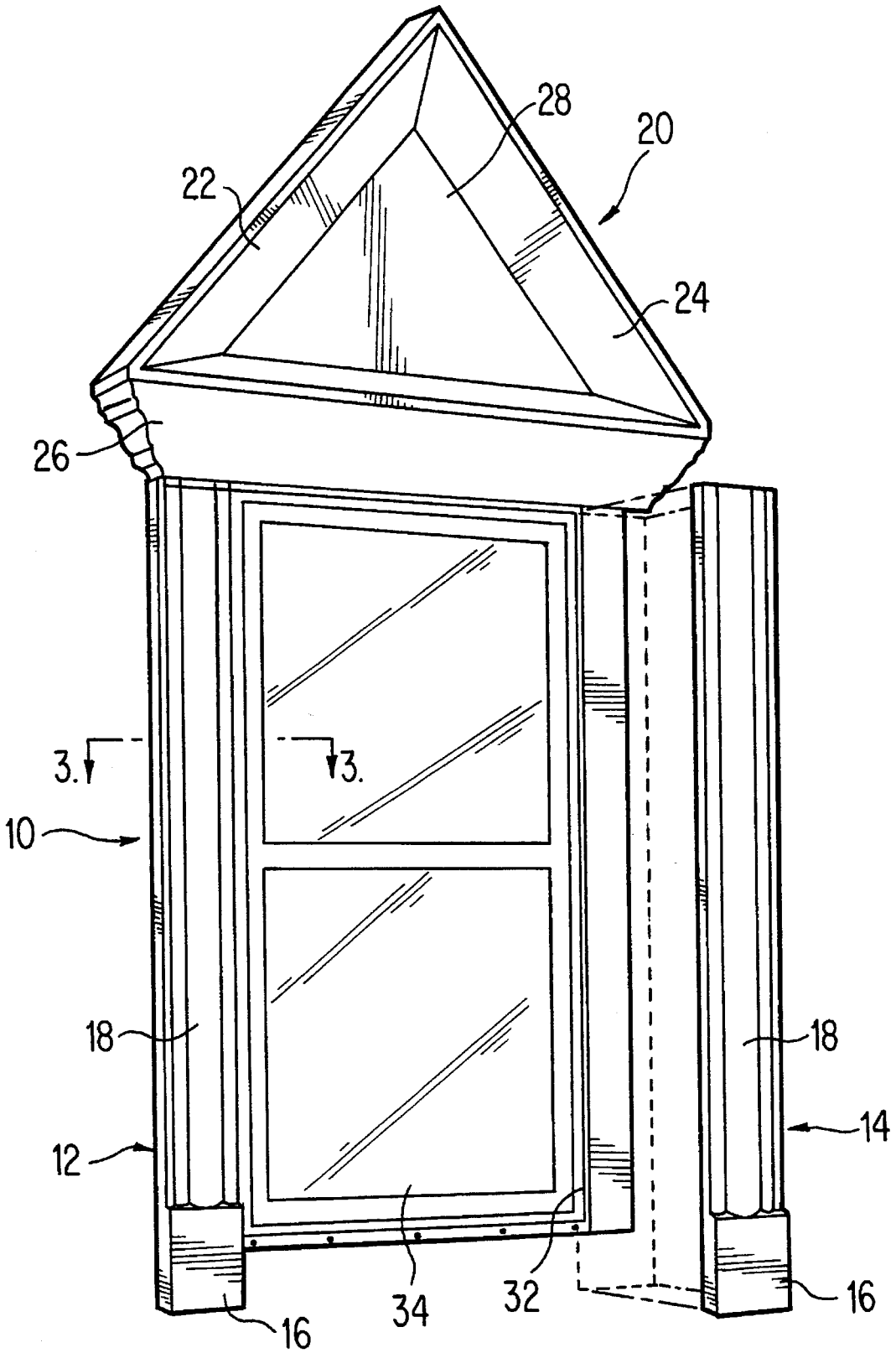
FIG. 1 is a perspective, partly exploded, view of an assembled dormer window facade incorporating the features of the invention.

Referring now to the drawings and particularly FIG. 1, shown there is the completed facade 10 for a dormer window constructed in accordance with the invention. The window facade frame includes decorative vertical side trim members 12, 14 each including a base 16 and a staff 18. Though the trim members have the appearance of expensive wood millwork they are, in fact, composed of foamed plastic fabricated in a known manner by the injection of liquified plastic containing a foaming or blowing agent into a rigidly closed mold which prevents the plastic from expanding to the extent that it naturally would were it not confined in the mold. The resulting product is a weatherproof body of dense material having the appearance and texture of painted wood millwork of any desired configuration. The molded members, however, have only slight structural strength and in the absence of the present invention, there would be no convenient and secure way for fixing the trim members to underlying structural members of the facade assembly. In addition to the side trim members 12, 14, the dormer facade of FIG. 1 includes a gabled pediment 20 which includes upwardly converging side parts 22, 24 a base part 26, and a central triangular panel 28. As with the side trim members, the pediment 20 has the appearance of being constructed of expensive wood millwork but in actuality it is comprised of plastic molded in the same manner as described above for the side trim members. Though the pediment 20 is shown in peaked gabled form, it could have an arcuate or any other gable shape consistent with customary architectural designs for dormers. The dormer assembly includes a standard window frame 32 and conventional glazed sashes or casements 34.

Figure 2:
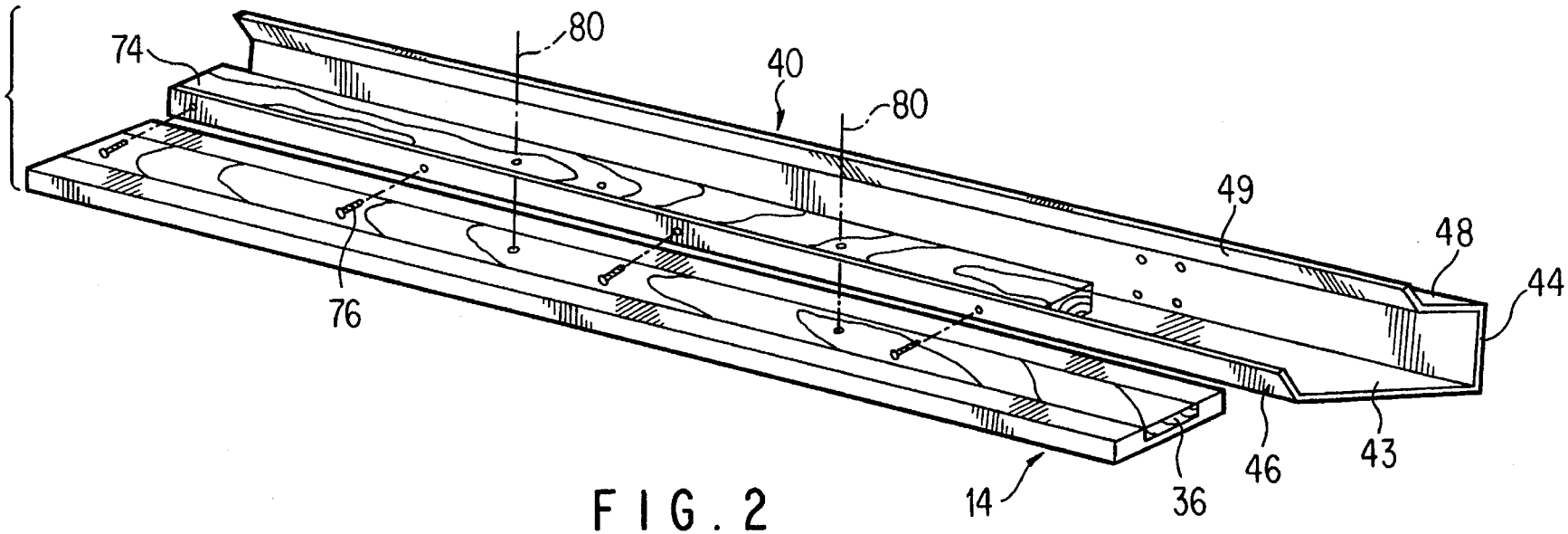
FIG. 2 is an exploded perspective view of certain of the side parts of the assembly of FIG. 1.

Referring now to FIG. 2, it will be noted that each trim member 12, 14 is molded about a wood board 36. To fabricate the composite molded trim member, the board 36 is first positioned centrally on the bottom of a mold. The plastic is then injected into the mold to surround the exposed sides and that board face which is remote from the mold bottom. After the trim member 14 is removed from the mold the board 36 is integrally and immovably embedded in the plastic material of the trim member with that face of the board which had engaged the bottom of the mold fully exposed. Not only does the board give structural strength to the molded trim member but it also is positioned to receive fastening elements 80, such as screws, to connect the trim member in its position of use to either side of the window frame as described in detail below.

Figure 4:
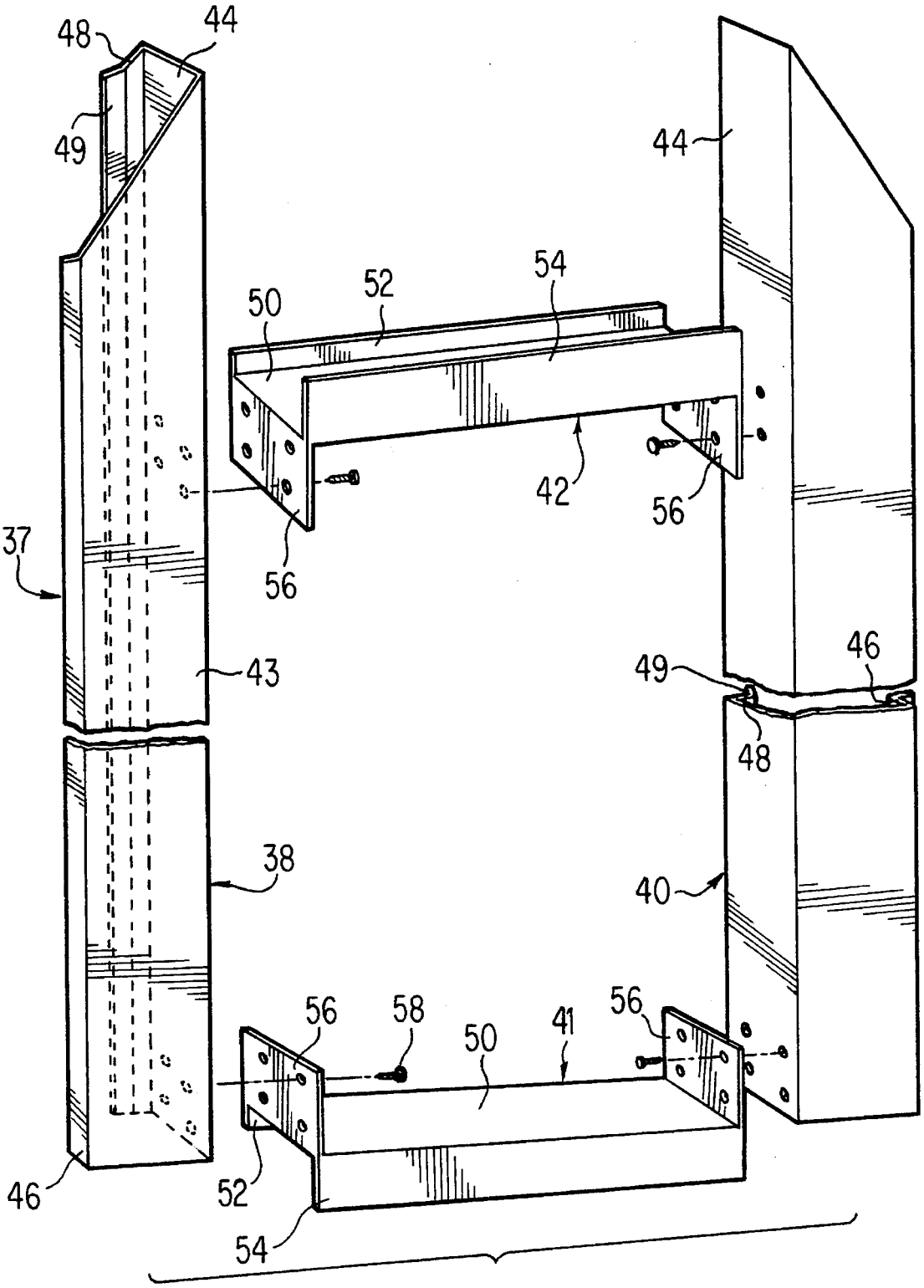
FIG. 4 is a broken exploded perspective view of metallic components defining a skeleton frame for the assembly of FIG. 1.

In accordance with the invention and as seen in FIG. 4, the dormer facade includes a sheet metal skeleton 37 composed of a pair of vertical side members 38, 40 and a pair of horizontal interconnecting lower and upper cross members 41, 42. Each side member has a first flat wall 43 which has a width greater than that of 2×4 lumber for reasons that will become apparent. Bent at right angles along the edge of wall 43 is a side wall 44 having a width complementary to that of a standard commercial window frame. A flange 46 having a depth equal to the thickness of 2×4 lumber is bent at right angles along the outer edge of wall 43 of each side member 38, 40. A flange 48 is also bent at right angles to wall 44 of each side member and a flange 49 is bent outwardly at right angles to the flange 44. The purpose of the latter bends will become apparent.

The cross members 41, 42 of the skeleton frame 31 comprise a pair of identical U-shaped channel members each having a rectangular base 50 having a length complementary to the width of preexisting window frame. Each cross member 41, 42 has a pair of side flanges 52, 54 bent at right angles to the base 50 and a pair of end flanges 56 bent at right angles to the base member in a direction opposite to the side flanges. As can be seen in FIG. 4 the side flanges 52, 54 have different heights for reasons which will become apparent. The end flanges 56 of the lower cross member 41 are secured by screws 58 to the extreme lower ends of the side members 38, 40 of the skeleton frame with the side flanges 52, 54 extending below the ends of the side frames. The upper cross member 42 is reversed from the lower cross member 41 with the side flanges 52, 54 extending upwardly but with its higher flange 54 lying in the same plane as the higher flange 54 of the lower cross member 41. The vertical end flanges of the upper cross member 42 are joined by screws 58 to the side members 38, 40 at a distance above the lower cross member which is complementary to the height of a preexisting window frame. When the skeleton 37 is completely assembled it defines an opening 60 (FIGS. 6 and 7) which is complementary to the size of preexisting window frames.

Figure 6:
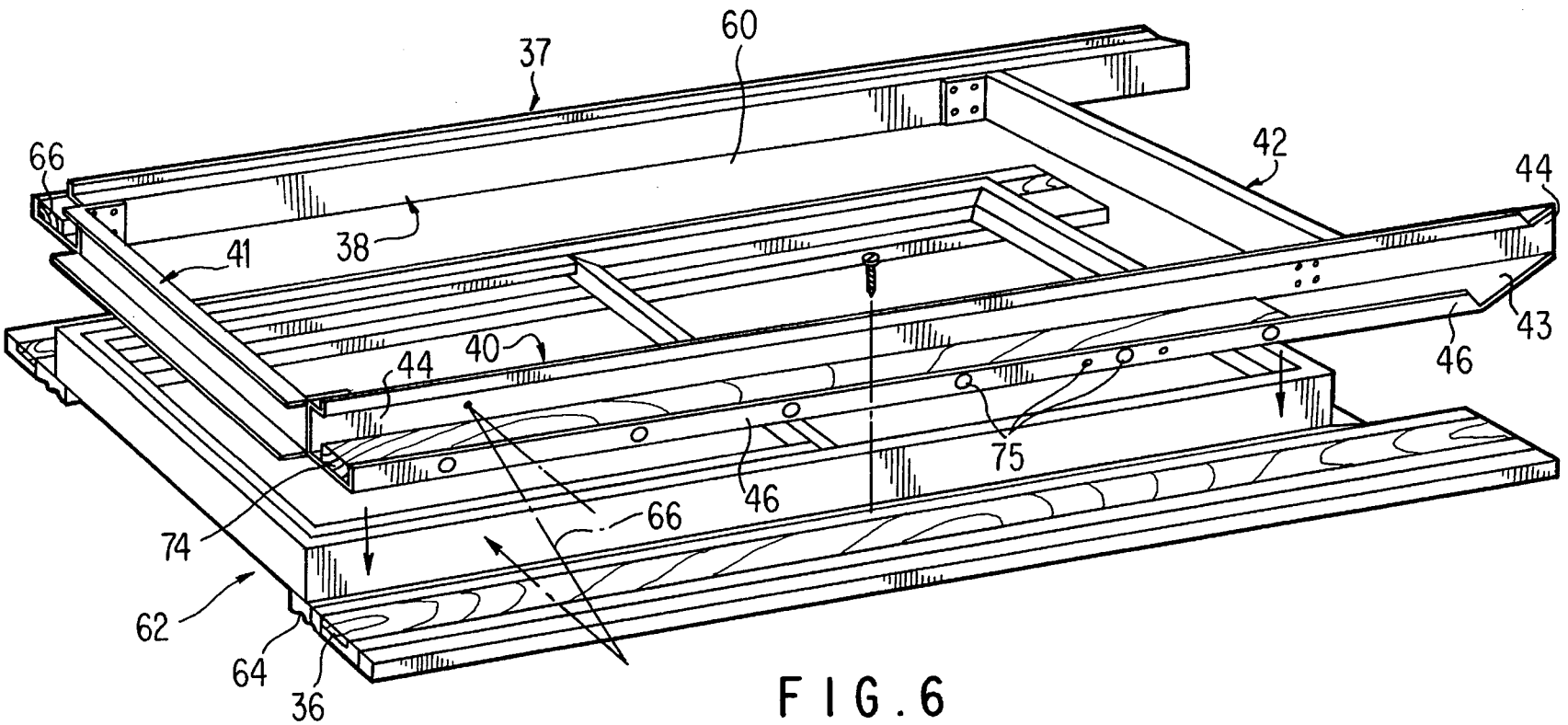
FIG. 6 is an exploded perspective view showing the manner whereby a pre-existing, standard window frame provided with a brick mold may be joined to the skeleton of FIG. 4.

The standard window frame 62 illustrated in FIG. 6 is of the type which is provided on its front face with a wood flange 64 known as a brick mold whose normal function is to bridge gaps between the frame and bricks of a wall in which a window opening is formed. With a standard window frame 62 of this type, the frame is first laid on a flat horizontal surface whereupon the skeleton window opening 60 is lowered over the frame and the walls 44 of the side numbers are screwed into the wood sides of the window frame as indicated by the zig-zag dashed line 66 in FIG. 6. The ends of the frame could also be screwed into the bases 50 of the cross members 41, 42.

Figure 7:
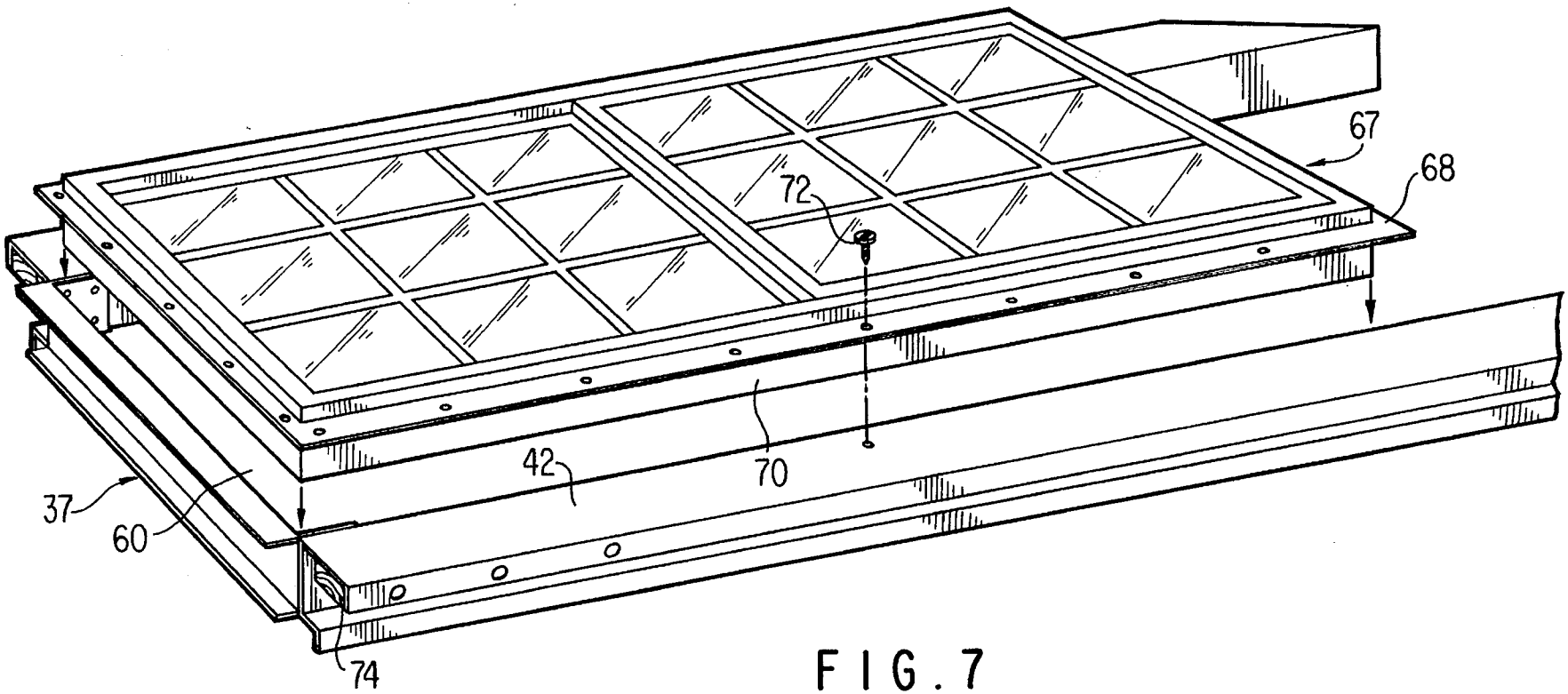
FIG. 7 is an exploded perspective view showing the manner whereby a second pre-existing, standard window frame provided with a nailing strip may be joined to the skeleton of FIG. 4.

Another type of conventional window frame is provided with a nailing strip. Such a window frame is illustrated at 67 in FIG. 7 with an enlarged view being shown in FIG. 3 and hereafter described in detail. The nailing strip 68 carried by the window frame 67 is the perforated horizontal leg of a metal inverted L-shaped band 70 screwed or otherwise fastened to the vertical edges of the window frame 67. As seen in FIG. 7, to assemble the frame 67 into the window opening 60 of the skeleton frame 37, the latter is first placed on a horizontal support with the inside surface of the wall 42 of the side members 38, 40 of the skeleton frame 37 facing downwardly. The window frame 67 is then lowered into the window opening 60 of the skeleton frame until the nailing strip engages the outer surfaces of the wall 42 whereupon the nailing strip 68 is fastened to the wall 42 by screws 72.

Figure 3:
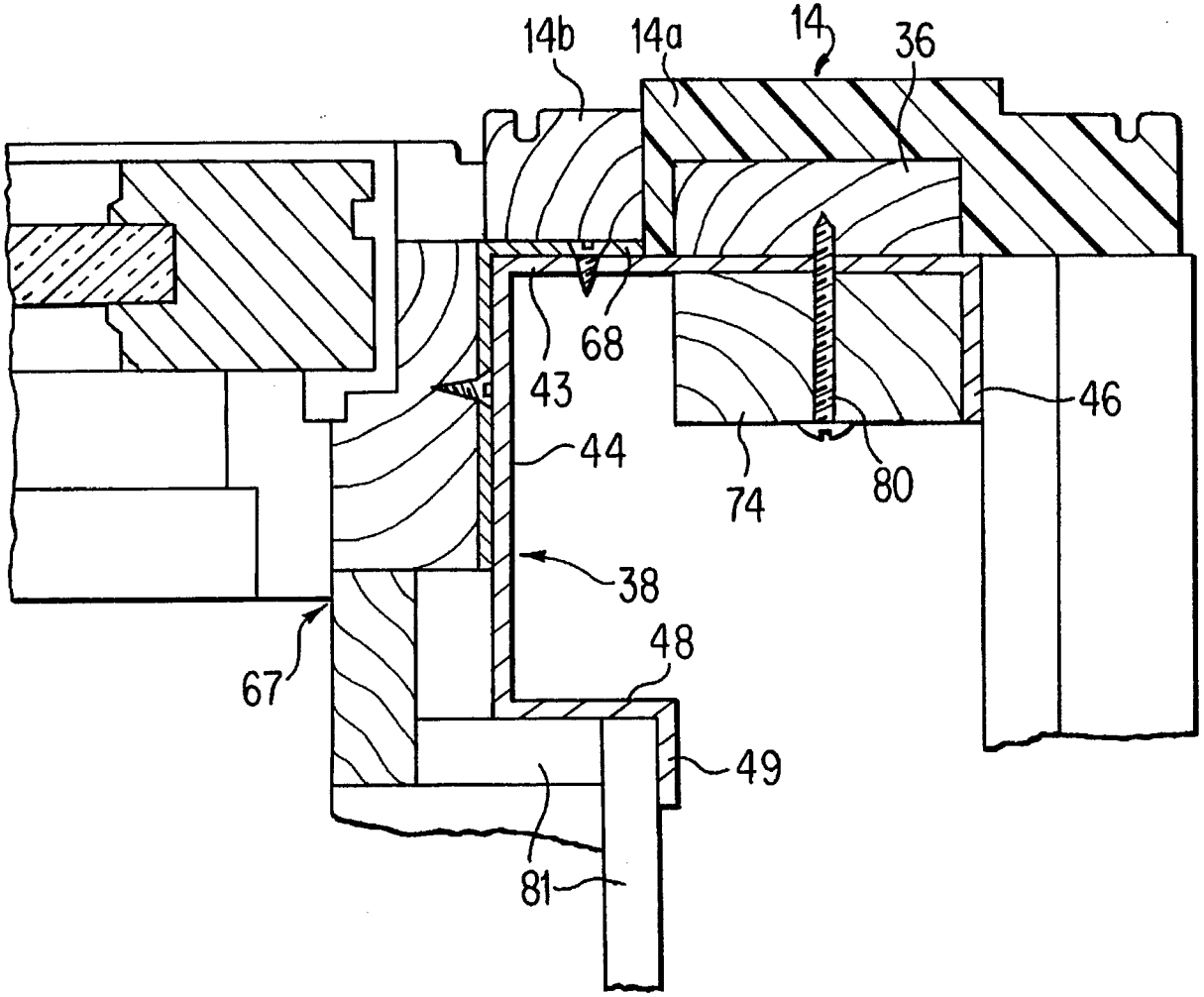
FIG. 3 is an enlarged horizontal cross sectional view taken substantially on the line 3—3 of FIG. 1.
Figure 5:
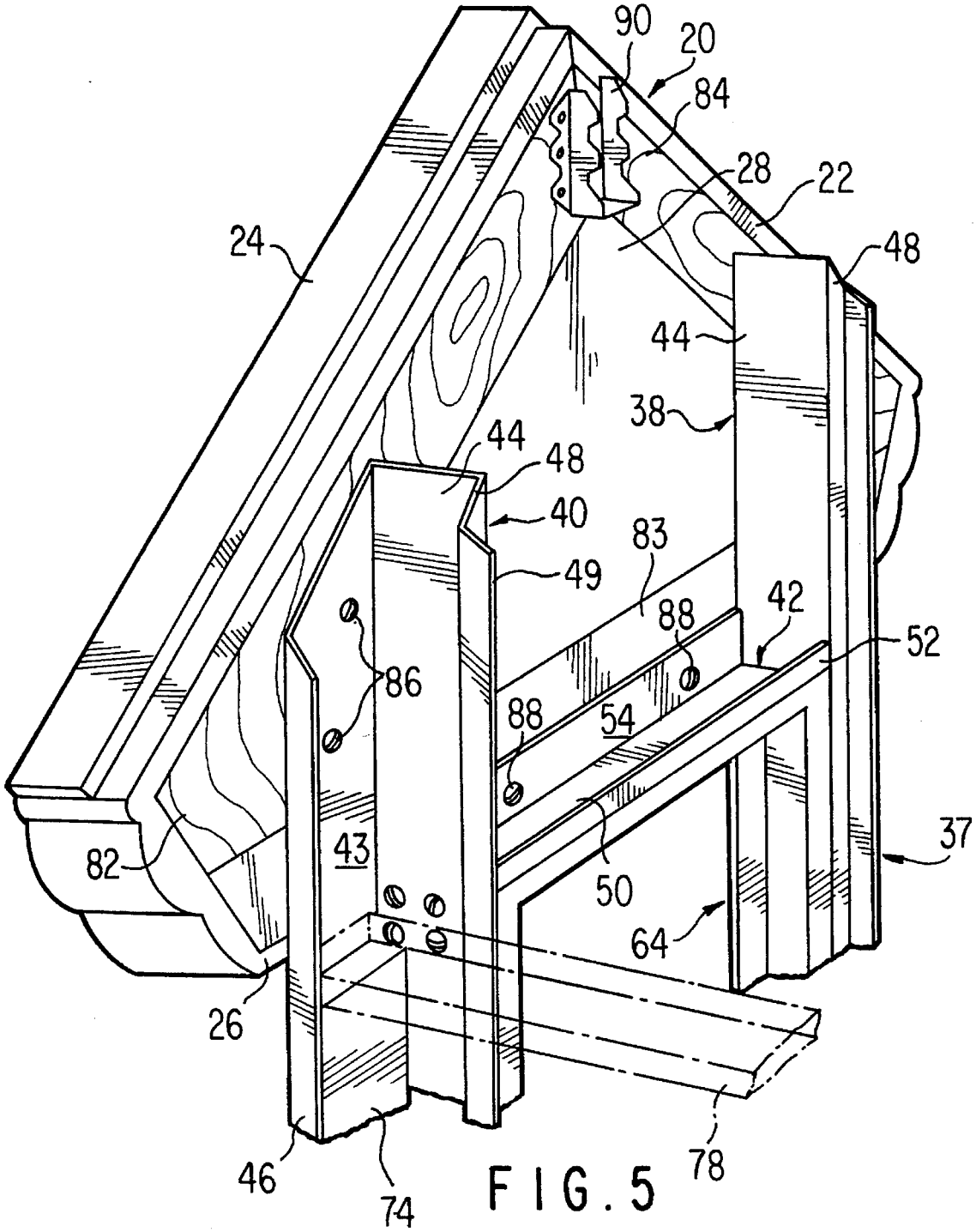
FIG. 5 is a broken rear perspective view of a pediment for a dormer window incorporating the invention.

As is clear in FIG. 6 and also in FIGS. 2, 3 and 5, 2×4 lumber 74 is placed on the inside of wall 43 of each skeleton side member 38, 40 in abutment with the flange 46 to which the lumber 74 may be screwed by screws 76 (FIG. 2) to the narrow side of the lumber. The lumber 74 has a length such that each extends from the lower end of a skeleton side member a predetermined distance along the flange 46 that when the dormer facade assembly is completed, the upper end of the 2×4 lumber 74 is positioned to serve as a support for horizontal lumber for the conventional construction of the sides and gable of the dormer between the facade and the roof. This horizontal lumber is known in the building trade as a plate and is illustrated in phantom lines at 78 in FIG. 5.

The 2×4 pieces of lumber 74 serve to strengthen and stiffen the skeleton side members 38, 40 and thus lend rigidity to the entire facade as well as serving as conventional vertical supports for plates 78. Finally with reference to FIG. 3 the 2×4's 74 receive screws 80 which pass through the 2×4's 74, the wall 43 of each skeleton side member and into the boards 36 embedded into the molded plastic trim members 12, 14.

As shown in FIG. 3 each trim member may be made of two molded parts 14*a* and 14*b*, the part 14*b* being known as a closure piece which may be shaved slightly as necessary to fit between the side of the part 14*a* of the trim and the window frame, the latter in FIG. 3 being the frame 67, illustrated in FIG. 7 and carrying the nailing strip 68. The closure piece 14*b* is readily adhered to the part 14*a* by adhesive well known in the art.

It will be noted in FIG. 3 that the bends 48, 49 of the side members abut sheathing 81 and other structural parts of the dormer forming no part of the present invention.

Turning now to FIG. 5 in which the rear of the pediment 20 is illustrated, it will be seen that the pediment 20 like the side trim members is molded around boards 82, 83, 84 in the same fashion as the side trim members. As can be seen in FIG. 5, the upper ends of the side members 38, 40 of the skeleton frame 37 are cut along slopes parallel to the slopes of the pediment side parts 22, 24 and the upper ends are secured to the upwardly sloping embedded boards 82 and 84 by screws 86. Clearly additional screws (not shown) could also be used to attach the upper ends of the side frame member to the horizontal embedded board 83. The higher flange 54 of the cross member 42 is also secured by screws 88 into the horizontal embedded board 83. It will now be apparent why the flange 54 is higher than the flange 52 and that is to permit the unobstructed driving of the screws 88. The embedded side boards 82, 84 where they abut at the pediment peak provide means for fixing a standard joist support 90 at the peak of the pediment.

In use, the several components of the dormer facade structure are shipped to the building site in knock-down condition. The lower ends of the skeleton side members are cut to conform to the building plans for the dormer height. Though the order in which the components are assembled can vary to suit circumstances, usually the skeleton frame is first assembled to provide the opening 60 for a pre-existing window frame which could be either of the frames 62, 67 shown in FIGS. 6 and 7 respectively, or some other not shown. The window frame is assembled into the opening 60 in one manner or another as described above and secured in place by screws. After this, the 2×4 lumber pieces 74 are secured in place by screws 76 whereupon the side trim piece 12, 14 are laid face down on a support surface and the screws 80 as best seen in FIG. 3 are driven through the 2×4's 74 and the wall 43 of the side frame member into the boards 36 embedded within the side trim members. A similar operation is followed for connecting the pediment 20 to the upper end of the skeleton frame as described in connection with FIG. 5.

The assembled facade may then be secured into the usual roof opening and the dormer completed in accordance with usual carpentry practices. The lower cross member 41 best seen in FIG. 4 is positioned to straddle and be fastened to complementary lumber as will be apparent to those skilled in the carpentry practices.

Having now fully described the invention what is claimed is:

What is claimed is:

1. A facade for a window, said facade comprising:

a pair of vertical side trim members and a pediment member having front and rear sides, all of said members having rear faces, said members being of foamed plastic material molded around and embedding wooden boards;

a skeleton frame including a pair of side members, each of said side members having first and second walls disposed at right angles to each other, each of said walls having a front and rear face, a pair of cross members connected to the first walls of said side members at longitudinally spaced positions to define with said first walls an opening for the reception of a window frame, said front faces of said second walls engaging the exposed rear faces of said embedded wooden boards, and fasteners extending through said second walls into said embedded boards for securing said side trim and pediment members to said skeleton frame.

2. The facade of claim 1 which comprises a piece of longitudinally extending structural lumber engaging each rear face of said second walls, said fasteners extending, in addition, through said lumber, then said second walls and into said embedded boards.

3. The facade of claim 2 wherein said second wall has a flange extending rearwardly at right angles to said second wall and said lumber is rectangular in cross-section having a side face abutting said flange and a front face abutting the rear face of said second wall.

4. The facade of claim 3, which comprises horizontal structural members having outer ends, wherein said lumber has upper ends terminating at positions to receive and support the outer ends of the horizontal structural members.

* * * * *